US010822061B2

(12) United States Patent
McCarthy

(10) Patent No.: US 10,822,061 B2
(45) Date of Patent: Nov. 3, 2020

(54) SYSTEMS AND METHODS FOR RIGHTING A CAPSIZED WATERCRAFT

(71) Applicant: Michael J. McCarthy, Seminole, FL (US)

(72) Inventor: Michael J. McCarthy, Seminole, FL (US)

(73) Assignee: See Through Canoe, Inc., Seminole, FL (US)

( * ) Notice: Subject to any disclaimer, the term of this patent is extended or adjusted under 35 U.S.C. 154(b) by 136 days.

(21) Appl. No.: 16/153,726

(22) Filed: Oct. 6, 2018

(65) Prior Publication Data

US 2019/0135388 A1 May 9, 2019

Related U.S. Application Data

(60) Provisional application No. 62/569,274, filed on Oct. 6, 2017.

(51) Int. Cl.
*B63B 43/14* (2006.01)
*B63B 43/02* (2006.01)
*B63B 34/26* (2020.01)

(52) U.S. Cl.
CPC ..... *B63B 43/02* (2013.01); *B63B 34/26* (2020.02); *B63B 2043/145* (2013.01)

(58) Field of Classification Search
CPC ... B63B 2043/145; B63B 34/20; B63B 34/21; B63B 34/22; B63B 34/23; B63B 34/26; B63H 16/04
See application file for complete search history.

(56) References Cited

U.S. PATENT DOCUMENTS 5,411,425 A * 5/1995 Rinker ..... B63C 9/08 441/130
2014/0007805 A1* 1/2014 Wooldridge ..... B63C 7/003 114/347

OTHER PUBLICATIONS

Riverstones Paddle Float, for sale on Amazon at least Jul. 2016 based on comments, https://www.amazon.com/Riverstones-Paddle-Float/dp/B00DVE34UK, retrieved Apr. 14, 2020 (Year: 2016).*

* cited by examiner

*Primary Examiner* — Andrew Polay
(74) *Attorney, Agent, or Firm* — Culhane Meadows PLLC

(57) ABSTRACT

Systems and methods for righting a capsized watercraft are described. The system may include a selectively inflatable bladder inside a canvas gunwale float that can be releasably attached to one side of a boat. When the other side of the boat is lifted, the float keeps at least a portion of the lowermost gunwale above the surface of the water, thereby impeding the unwanted entry of water into the boat during righting. The inflatable bladder is sized in volume according to the size and shape of the boat. The system may include one or more floats spaced apart along the side. In another aspect, one of the floats may be attached to a paddle to create a temporary outrigger for use in climbing out of the water and into the boat.

7 Claims, 6 Drawing Sheets

SYSTEMS AND METHODS FOR RIGHTING A CAPSIZED WATERCRAFT

CROSS REFERENCE TO RELATED APPLICATIONS

The present application claims the benefit of and priority to U.S. Provisional Application 62/569,274 filed Oct. 6, 2017, and entitled, "Watercraft Entry and Righting Systems and Methods," which is incorporated herein by reference in its entirety.

BACKGROUND

Certain disclosed embodiments relate to the field of boating and, more particularly, to systems and methods for righting a capsized watercraft.

Lifting and righting a capsized boat in the water, especially deep water, is physically challenging or impossible for many boaters. Even if the boat can be righted, the process often allows a large volume of water to enter the boat. Typically, when a boat overturns or capsizes, the boat partly fills with water and at least one side of the boat is underwater. Unless the boater is capable of lifting most of the boat above the water before turning it over, water typically pours over the lowermost side and into the boat during the righting process. Boats that have a generally low center of gravity, such as canoes or kayaks, typically float very low in the water when capsized. Currently available systems and techniques for righting a capsized boat require permanent modifications to the boat and/or the onboard storage of additional equipment, and most result in a substantial volume of water entering the boat. Thus, there is a need in the art for improved systems and methods for righting a capsized watercraft.

SUMMARY

A system for righting a capsized boat is described. According to various embodiments, the system includes a primary gunwale float having at least one selectively openable loop that is sized and shaped to releasably secure the primary gunwale float near a distal gunwale of a boat. The primary gunwale float defines a bladder pouch for supporting a selectively inflatable bladder. The primary gunwale float lifts at least a portion of the distal gunwale at least partially above the surface of a body of water and thereby impedes the entry of water into the boat when at least a portion of a proximal gunwale of the boat is lifted at least partly above the surface by a boater.

The boat may include a distal side rail attached near the distal gunwale. The at least one selectively openable loop is sized and shaped to releasably secure the primary gunwale float to the distal side rail.

The bladder may include a valve extending through an opening in the bladder pouch.

The primary gunwale float may include a top layer, a bottom layer, and an intermediate layer, wherein the top layer and the intermediate layer define the bladder pouch.

The primary gunwale float may further include an open end and a closed end, wherein the top layer and the bottom layer define a long pouch that extends from the open end to near the closed end and is sized and shaped to releasably receive a part of a paddle.

The system may also be used to facilitate the entry of a person from the water into a righted boat. The system may include an outrigger comprising the part of a paddle inserted into the long pouch of the primary gunwale float, wherein the selectively inflatable bladder is sized and shaped, when inflated, to releasably secure the long pouch to the part of a paddle. The system may also include at least one strap for releasably securing the outrigger to at least one thwart of the righted boat, such that the outrigger supports a person climbing out of the water and into a righted boat.

The primary gunwale float may have a bottom layer and a top layer, a first edge and a generally opposing second edge. The primary gunwale float may further include (1) a top elongate fastener oriented lengthwise along and near the first edge and attached to the top layer and (2) a bottom elongate fastener oriented lengthwise along and near the second edge and attached to the bottom layer, wherein the primary gunwale float is sized in width to facilitate the mating and releasable attaching of the top and bottom elongate fasteners when the primary gunwale float is wrapped around a generally cylindrical support on the boat.

The system may further include a secondary gunwale float having at least one secondary selectively openable loop that is sized and shaped to releasably secure the secondary gunwale float near a distal gunwale of a boat, wherein the secondary gunwale float defines a secondary bladder pouch for supporting a selectively inflatable secondary bladder. The secondary gunwale float may lift at least a portion of the distal gunwale at least partially above the surface of a body of water and thereby impedes the entry of water into the boat when at least a portion of a proximal gunwale of the boat is lifted at least partly above the surface by a boater.

The primary gunwale float and the secondary gunwale float may cooperate to lift at least a portion of the distal gunwale.

The primary gunwale float and the secondary gunwale float may be spaced apart along the distal gunwale.

The boat may include a distal side rail attached near the distal gunwale. The at least one secondary selectively openable loop may be sized and shaped to releasably secure the secondary gunwale float to the distal side rail.

The secondary bladder includes a secondary valve extending through a secondary opening in the secondary bladder pouch.

The secondary gunwale float has a secondary bottom layer and a secondary top layer, a secondary first edge and a generally opposing secondary second edge. The secondary gunwale float may further include (1) a secondary top elongate fastener oriented lengthwise along and near the secondary first edge and attached to the secondary top layer and (2) a secondary bottom elongate fastener oriented lengthwise along and near the secondary second edge and attached to the secondary bottom layer, wherein the secondary gunwale float is sized in width to facilitate the mating and releasable attaching of the secondary top and bottom elongate fasteners when the secondary gunwale float is wrapped around a generally cylindrical support on the boat.

The secondary gunwale float comprises a secondary top layer, a secondary bottom layer, and a secondary intermediate layer, wherein the secondary top layer and the secondary intermediate layer define the secondary bladder pouch.

The secondary gunwale float further includes a secondary open end and a secondary closed end, wherein the secondary top layer and the secondary bottom layer define a secondary long pouch that extends from the secondary open end to near the secondary closed end and is sized and shaped to releasably receive a part of a paddle.

The system may be used to facilitate the entry of a person from the water into a righted boat. The system may include a secondary outrigger comprising the part of a paddle inserted into the secondary long pouch of the secondary gunwale float, wherein the secondary selectively inflatable bladder is sized and shaped, when inflated, to releasably secure the secondary long pouch to the part of a paddle. The system may also include at least one secondary strap for releasably securing the secondary outrigger to at least one thwart on the righted boat, such that the secondary outrigger supports a person climbing out of the water and into a righted boat.

In a related aspect, a method of righting a capsized boat is described. The method may include the steps of (1) providing a primary gunwale float having at least one selectively openable loop, the primary gunwale float defining a bladder pouch for supporting a selectively inflatable bladder; (2) inflating the selectively inflatable bladder; (3) attaching the at least one selectively openable loop to a boat on or near a distal gunwale of the boat; and (4) lifting a proximal gunwale of the boat above the surface of the water, while the primary gunwale float lifts at least a portion of the distal gunwale at least partially above the surface and thereby impedes the entry of water into the boat, until the boat is righted.

Where the boat includes a distal side rail mounted near the distal gunwale, the step of attaching may include fastening the at least one selectively openable loop to the distal side rail.

Where the primary gunwale float comprises a top layer, a bottom layer, and an intermediate layer, the top layer and the intermediate layer define the bladder pouch, the primary gunwale float further includes an open end and a closed end, at least a portion of the top layer and the bottom layer define a long pouch that extends from the open end to near the closed end, and the method of righting may further include a supplemental method of facilitating the entry of a person from the water into a righted boat. The supplemental method may include the steps of (a) inserting a part of a paddle into the long pouch; (b) inflating the selectively inflatable bladder to releasably secure the long pouch to the part of a paddle, to form an outrigger; (c) securing the outrigger to at least one thwart of the righted boat; and (d) using the outrigger to climb out of the water and into the righted boat.

The method may further include the steps of: (5) providing a secondary gunwale float having at least one secondary selectively openable loop the secondary gunwale float defining a secondary bladder pouch for supporting a selectively inflatable secondary bladder; (6) inflating the selectively inflatable secondary bladder; (7) attaching the at least one secondary selectively openable loop to a boat on or near the distal gunwale of the boat, spaced apart from the primary gunwale float; and (8) lifting a proximal gunwale of the boat above the surface of the water, while the primary gunwale float and the secondary gunwale float cooperate to lift at least a portion of the distal gunwale at least partially above the surface and thereby impedes the entry of water into the boat, until the boat is righted.

Where the boat includes a distal side rail mounted near the distal gunwale, the step of attaching may include fastening the at least one secondary selectively openable loop to the distal side rail.

Other apparatuses, methods, systems, features, and advantages of the disclosed embodiments will be apparent to one of ordinary skill in the art upon examination of the following drawing figures and detailed description. All such additional apparatuses, methods, systems, features, and advantages are intended to be included within this description and to be included within the scope of the accompanying claims.

BRIEF DESCRIPTION OF THE DRAWING

Features of the various embodiments disclosed will become more apparent in the following detailed description, in which reference is made to the appended drawing, wherein.

Corresponding reference numbers indicate corresponding parts or elements throughout the several views of the drawing.

DETAILED DESCRIPTION

Figure 1:
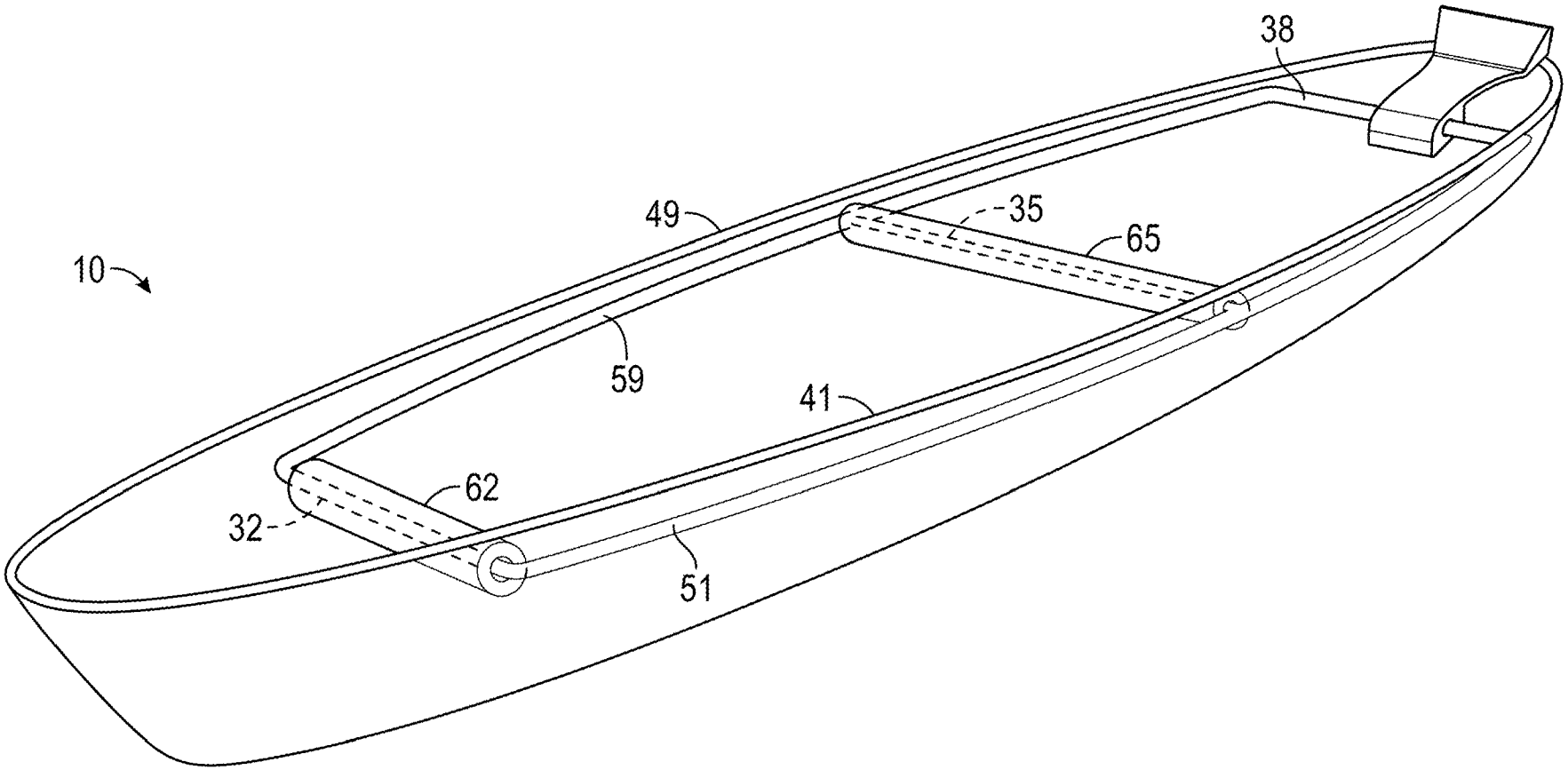
FIG. 1 is a perspective illustration of a watercraft equipped with side rails and several thwarts.

The present systems and apparatuses and methods are understood more readily by reference to the following detailed description, examples, drawings, and claims, and their previous and following description. However, before the present devices, systems, and/or methods are disclosed and described, it is to be understood that this invention is not limited to the specific devices, systems, and/or methods disclosed unless otherwise specified, as such can, of course, vary. It is also to be understood that the terminology used herein is for the purpose of describing particular aspects only and is not intended to be limiting.

Like parts are marked throughout the following description and drawings with the same reference numerals. The drawings may not be to-scale and certain features may be shown exaggerated in scale or in somewhat schematic format in the interest of clarity, conciseness, and to convey information.

The following description of the invention is provided as an enabling teaching of the invention in its best, currently known embodiment. To this end, those skilled in the relevant art will recognize and appreciate that many changes can be made to the various aspects of the invention described herein, while still obtaining the beneficial results of the present invention. It will also be apparent that some of the desired benefits of the present invention can be obtained by selecting some of the features of the present invention without utilizing other features. Accordingly, those who work in the art will recognize that many modifications and adaptations to the present invention are possible and can even be desirable in certain circumstances and are a part of the present invention. Thus, the following description is provided as illustrative of the principles of the present invention and not in limitation thereof.

As used throughout, the singular forms "a," "an" and "the" include plural referents unless the context clearly dictates otherwise. Thus, for example, reference to a component can include two or more such components unless the context indicates otherwise.

Ranges can be expressed herein as from "about" one particular value and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

As used herein, the terms "optional" or "optionally" mean that the subsequently described event or circumstance may or may not occur, and that the description includes instances where said event or circumstance occurs and instances where it does not.

As used herein, the term "facilitate" means to aid, assist, or make easier. The term "impede" means to interfere with, hinder, or delay the progress.

As used herein, the terms "proximal" and "distal" are used to describe items or portions of items that are situated closer to and away from, respectively, a user or operator. Thus, for example, the side of an item nearest a person may be referred to as the proximal side, whereas the generally opposing side or far side may be referred to as the distal side.

The terms watercraft, vessel, and boat are used herein in the broadest sense. Those of ordinary skill will understand that the term watercraft may be used to describe and encompass any of a variety of vessels that travel on water, including but not limited to a boat, canoe, kayak, dinghy, skiff, dory, flat-bottomed boat, bass boat, inflatable boat, sailboat, paddle boat, and personal water craft of all kinds. Although the various embodiments are described with reference to a canoe or kayak, the assemblies and systems described herein may be used with any type of watercraft.

Watercraft are described using nautical jargon, some of which is used herein. The front of a boat is referred to as the bow; the rear is the stern. For a boater facing toward the bow, the right side of the boat is called the starboard side; the left is the port side. Gunwale refers to the upper or top edge of the side of a boat. A boat may include one or more handles, short rails, or longer side rails running along or mounted near the gunwales. A thwart refers to a cross beam or strut that spans the width of the boat, between the gunwales or sides of the boat. A thwart may be used as a handle, may include a seat, and may be covered by one or more cushions. A boat may have several thwarts, such as a canoe which typically has a stern thwart, a center or midship thwart, and a bow thwart.

A boat such as a sailboat or a kayak may have a top surface called the deck. The cockpit of a kayak refers to the place where the boater sits. The coaming is a raised structure or rim that surrounds an opening, such as the cockpit of a kayak. A paddle, in general, has a grip, a shaft, a throat (near where the shaft meets the blade), and a blade that terminates or ends at the tip. A single-blade paddle generally has a grip or handle at the proximal end and a blade at the distal end. The grip or handle of a two-blade paddle is near the middle of the shaft, which supports paddle blades on both ends.

Although the various embodiments are described with reference to boating and watercraft, the assemblies and systems described herein may be used with any of a variety of activities and things.

FIG. 1 is a perspective illustration of a watercraft; in this example, a canoe 10 having a semi-transparent hull. The proximal gunwale 41 is the upper edge of the side nearest the viewer. The distal gunwale 49 is on the far side of the canoe 10. The canoe 10 is equipped with a proximal side rail 51 and a distal side rail 59. The canoe 10 has a bow thwart 32, a center or midship thwart 35, and a stern thwart 38. The bow thwart 32 is covered by a bow cushion 62. The center thwart 35 is covered by a center cushion 65.

Figure 2:
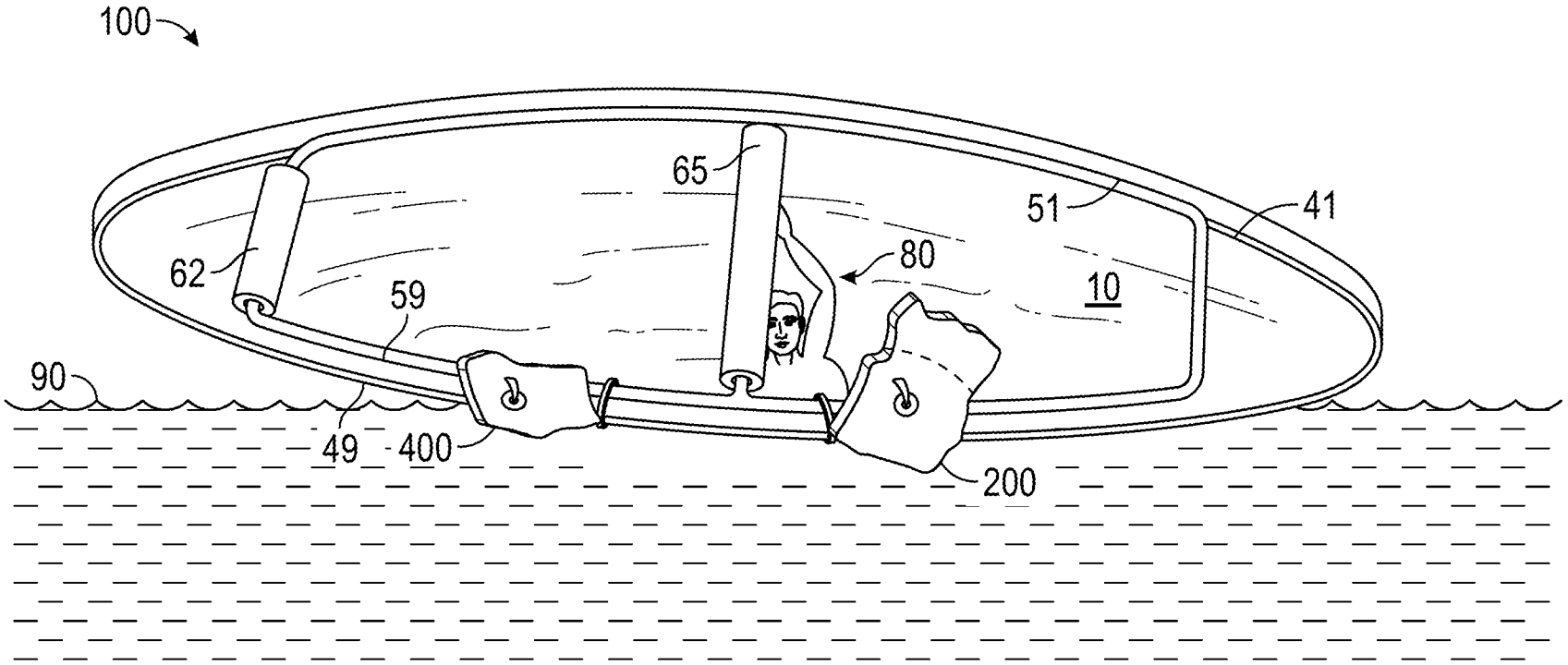
FIG. 2 is a perspective illustration of a watercraft being righted using a system for righting a capsized watercraft, according to various embodiments.

FIG. 2 is a perspective illustration of a system 100 for righting a capsized watercraft 10, according to various embodiments. A boater 80 can be seen through the semi-transparent hull, positioned generally behind and underneath the canoe 10. In one exemplary embodiment, the system 100 may include a primary gunwale float 200 releasably secured to the boat 10 near the distal gunwale 49. The float 200 may be attached to the distal side rail 59, as shown. The primary gunwale float 200 may define a bladder pouch for supporting a selectively inflatable bladder, as described herein. When attached and inflated, the primary gunwale float 200 may be sized and shaped to lift at least a portion of the distal gunwale 49 above the water surface 90 to impede water intrusion when the proximal gunwale 41 is lifted by the boater 80 during the righting process.

The boater 80, as shown, may begin to right the boat 10 by raising the center cushion 65, thereby lifting the proximal gunwale 41 out of the water while the primary gunwale float 200 lifts at least a portion of the distal gunwale 49 above the water surface 90. In this manner, the boat 10 can be righted with minimal intrusion of water.

According to another embodiment, the system 100 may include both a primary gunwale float 200 and a secondary gunwale float 400, as shown in FIG. 2. The secondary gunwale float 400 may or may not have the same construction and features as the primary gunwale float 200. Both floats 200, 400 may be releasably attached to the boat 10 near the distal gunwale 49. The floats 200, 400 may be attached to and spaced apart along the distal side rail 59, as shown. When attached and inflated, the floats 200, 400 may be sized and shaped to lift at least a portion of the distal gunwale 49 above the water surface 90 to impede water intrusion during the righting process.

Figure 3:
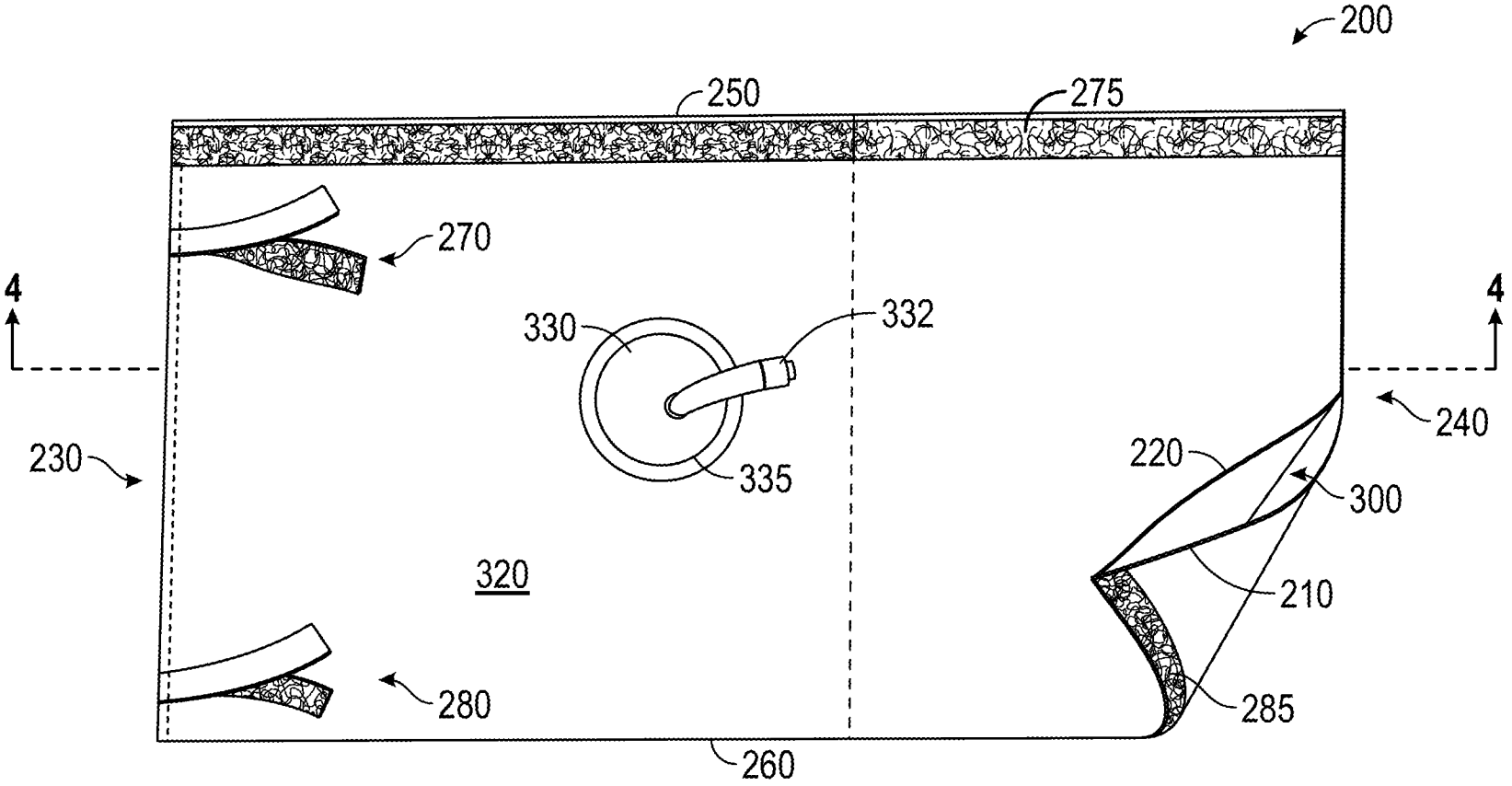
FIG. 3 is an illustration of a primary gunwale float, according to various embodiments.

The primary gunwale float 200 may include at least one selectively openable loop or other means for attaching the float 200 the side rail or other part of a boat. FIG. 3 is a perspective illustration of a primary gunwale float 200, according to various embodiments which includes a first selectively openable loop 270 and a second selectively openable loop 280. The loops 270, 280 as shown may be attached near the closed end 230 of the float 200. The loops 270, 280 may be elongate strips that are configured to attach to one another, such as a mating pair of hook-and-loop fastener strips. Any of a variety of other types of fastening means may be used to secure the float 200 to a side rail or other structure.

Figure 4:
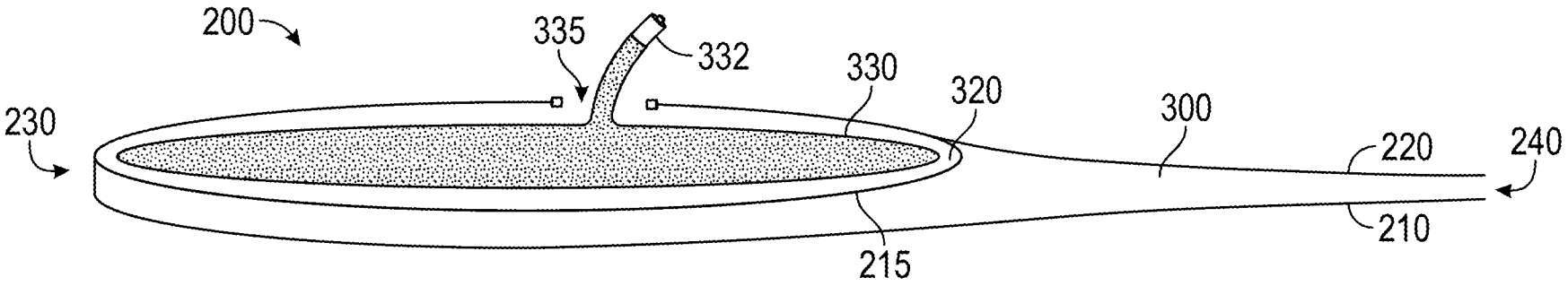
FIG. 4 is a cross-sectional view of the primary gunwale float, according to various embodiments.

The primary gunwale float 200 may be generally rectangular in overall shape and may include a bottom layer 210 and a generally opposing top layer 220. According to various embodiments, the float 200 may also include an intermediate layer 215 (as shown in FIG. 4). The layers 210, 215, 220 and other parts of the float 200 may be made of a fabric that is suitable for use in marine environments, such as water-resistant canvas, nylon cloth, or any of a variety of synthetic fabrics. The float 200, as shown, includes a first edge 250 (across the top, in FIG. 3) and a generally opposing second edge 260; a closed end 230 and a generally opposing open end 240.

The primary gunwale float 200 may define a bladder pouch 320 that is sized and shaped to support a selectively inflatable bladder 330. The bladder 330 may include an inflation valve 332 positioned in a filler tube that extends through an opening 335 in the top layer 220. The valve 332 may be a three-part two-port check valve, like the kind used for inflatable boats, mattresses, pool toys and the like, to prevent unintended deflation. The opening 335 may be a simple eyelet and may be reinforced by a grommet, as shown. The bladder pouch 320 may be defined by the top surface 220 and the intermediate layer 215 (shown graphically in FIG. 4) and may extend along only a portion of the length and width of the float near the closed end 230, as shown in FIG. 3. As shown, the intermediate layer 215 may extend from near the closed end 230 to an intermediate location, indicated by the dashed line in FIG. 3. The bladder 330 may be shaped to fit within the bladder pouch 320 and sized in volume to hold enough air to lift at least a portion of the gunwale of a boat far enough above the water to impede the intrusion of water into the boat during righting. In this aspect, the size and shape of the bladder 330, and the float 200 supporting it, will vary depending on the size and shape of the boat. The primary gunwale float 200, for example, may include several pouches for holding several bladders. Larger or heavier boats will require larger bladders housed within one or more larger floats. Moreover, longer boats such as canoes may benefit from the use of multiple bladders housed within multiple floats, spaced apart along the side, as described herein.

Figure 6:
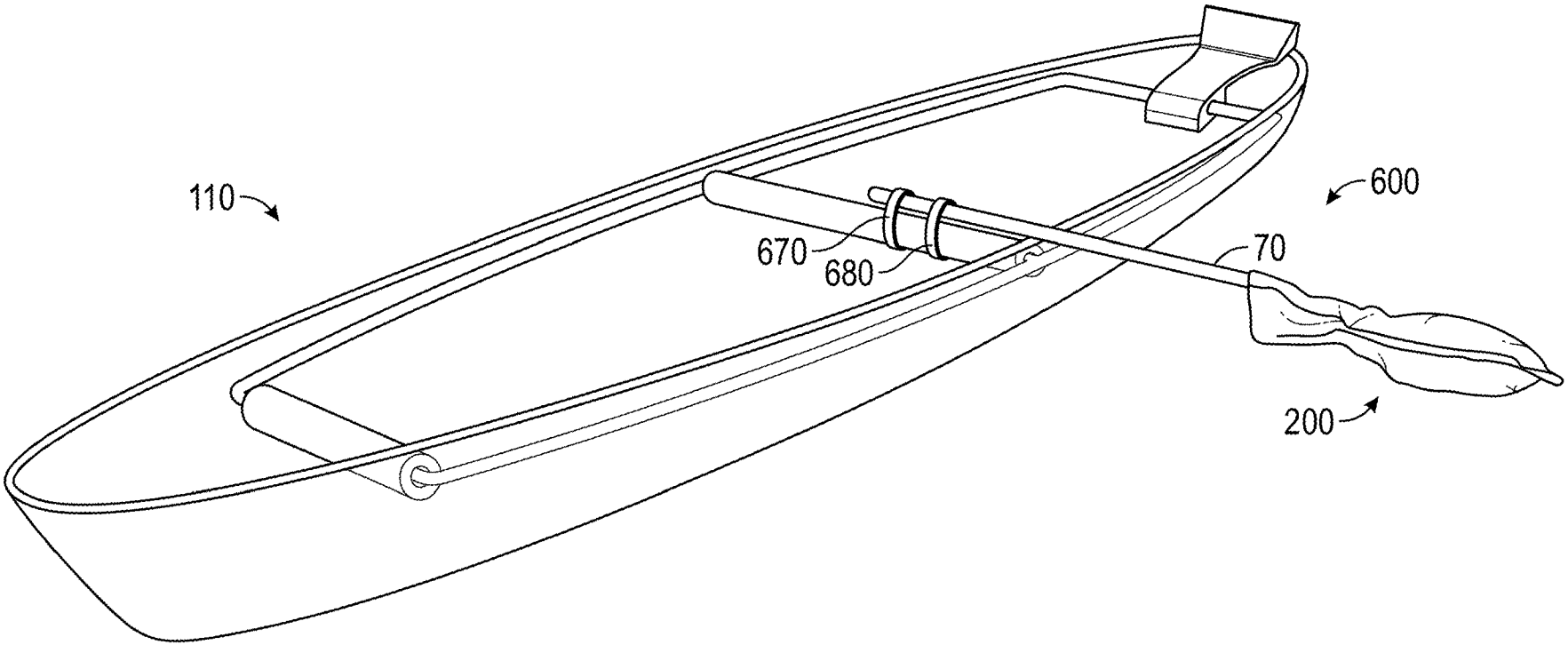
FIG. 6 is a perspective illustration of a system for facilitating the entry of a person from the water into a righted boat, according to various embodiments.

The primary gunwale float 200 may further include a long pouch 300. The long pouch 300, as shown in FIG. 3, may be defined by the bottom layer 210 and the top layer 220 and may extend along nearly the entire length and width of the float 200 from the open end 240 to the closed end 230. The long pouch 300 may be sized and shaped to releasably receive the blade or other part of a paddle 70 (as shown in FIG. 6). In use, as described herein, the blade of a paddle 70 may be inserted into the long pouch 300. When the bladder 330 is inflated, the intermediate layer 215 of the bladder pouch 320 may be forced against the paddle 70, thus helping to secure the float 200 to the paddle 70. In this aspect, the inflated primary gunwale float 200 when placed around the blade of a paddle 70 creates an outrigger 600 (as shown in FIG. 6) that extends over and beyond the gunwale. The outrigger 600 facilitates the stability of a righted boat and helps to support a person climbing out of the water and into the boat. The outrigger 600 may be secured to the boat, for example, by using one or more straps 670, 680 to releasably attach the outrigger 600 to one of the thwarts.

Referring again to FIG. 3, the top layer 220 may include a top elongate fastener 275 positioned along the first edge 250. The bottom layer 210 may include a bottom elongate fastener 285 along the second edge 260, as shown. The elongate fasteners 275, 285 may be elongate strips that are configured to attach to one another, such as a mating pair of hook-and-loop fastener strips. Other types of fasteners may be used that are suitable for marine environments. In this aspect, when the primary gunwale float 200 is wrapped around a cylindrical surface, such as one of the cushions on a thwart, the mating faces of the elongate fasteners 275, 285 will meet and connect. In one embodiment, the primary gunwale float 200 may be sized and shaped in width to fit around an elongate, generally cylindrical center cushion 65 on the center thwart 35 (as shown in FIG. 1) so that the float 200 can be stored around the cushion 65 and located easily when needed.

FIG. 4 is a cross section of the primary gunwale float 200 taken along line 4-4 of FIG. 3 as if it passes through the opening 335 and valve 332. The bladder 330 as shown is supported inside the bladder pouch 320, which defined by the top layer 220 and the intermediate layer 215. The long pouch 300 extends from the open end 240 to the closed end 230 and is defined by a portion of the top layer 220 and the entire bottom layer 210.

As described herein, the long pouch 300 is optional and not a necessary element of the primary gunwale float 200 in performing its function of lifting one of the gunwales during the righting of a capsized boat. In this aspect, one embodiment of the primary gunwale float 200 includes only a bladder pouch 320 defined by two layers of fabric. Referring to FIG. 4, this single-pouch embodiment would include only the intermediate layer 215 (now acting as a bottom layer) and the top layer 220; with no open end 240 between layers and no long pouch 300.

The system 100 may include one or more secondary floats, depending on the size, shape, and weight of the watercraft to be righted. As shown in FIG. 2, the system 100 may further include a secondary gunwale float 400. The secondary gunwale float 400 may be releasably secured to the boat 10 near the distal gunwale 49. The float 400 may be attached to the distal side rail 59, as shown. The secondary gunwale float 400 may define a secondary bladder pouch 520 for supporting a selectively inflatable secondary bladder 530, as described herein. When attached and inflated, the secondary gunwale float 400 may be sized and shaped to lift, by itself, at least a portion of the distal gunwale 49 above the water surface 90 and thereby impede water intrusion when the proximal gunwale 41 is lifted by the boater 80 during the righting process.

The secondary gunwale float 400 may or may not have the same construction and features as the primary gunwale float 200. Both floats 200, 400 may be releasably attached to the boat 10 near the distal gunwale 49. The floats 200, 400 may be attached to and spaced apart along the distal side rail 59, as shown. When attached and inflated, the floats 200, 400 may be sized and shaped to lift at least a portion of the distal gunwale 49 above the water surface 90 to impede water intrusion during the righting process.

Figure 5:
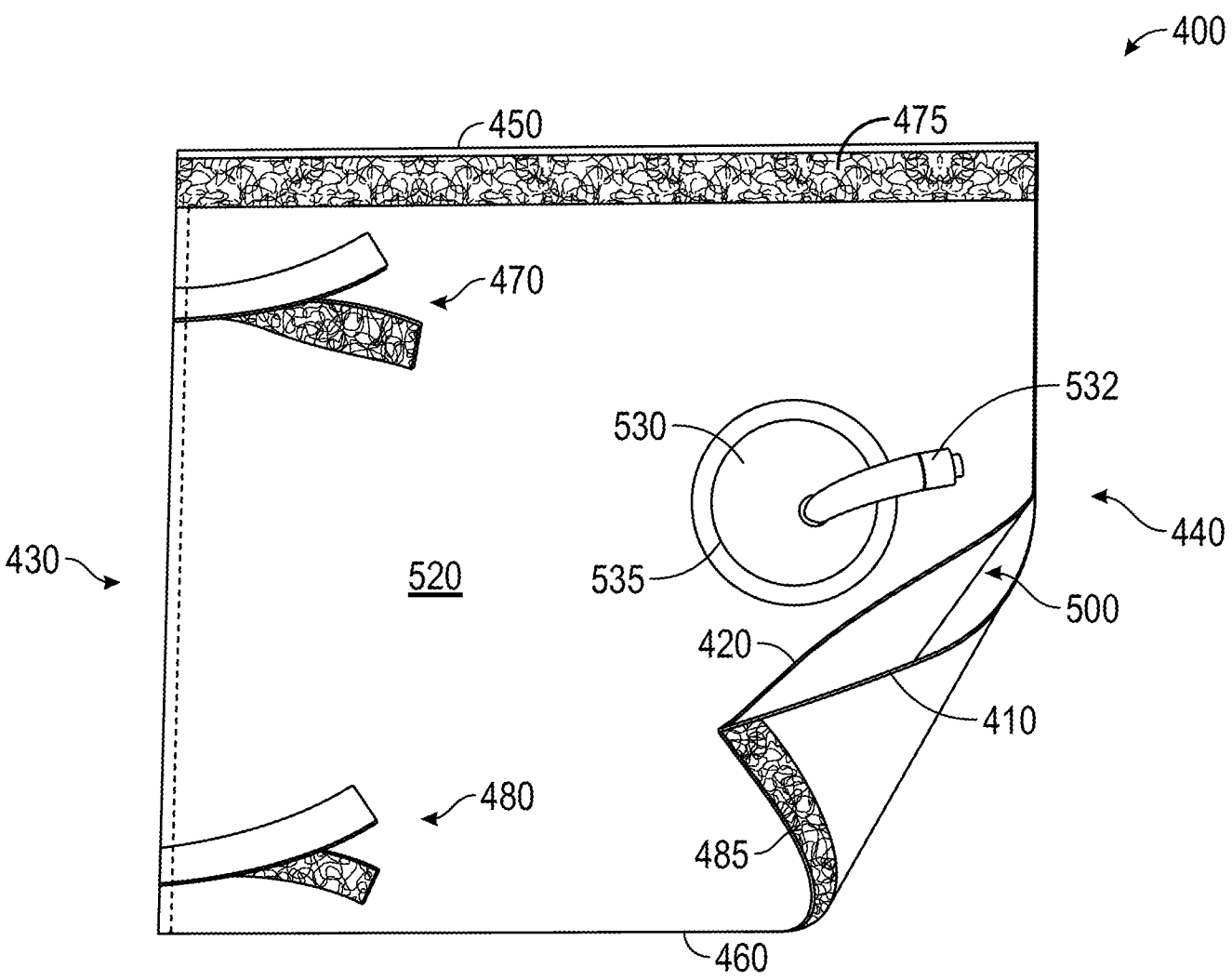
FIG. 5 is an illustration of a secondary gunwale float, according to various embodiments.

The secondary gunwale float 400 may include at least one selectively openable loop or other means for attaching the float 400 the side rail or other part of a boat. FIG. 5 is a perspective illustration of a secondary gunwale float 400, according to various embodiments which includes a secondary first selectively openable loop 470 and a secondary second selectively openable loop 480. The loops 470, 480 as shown may be attached near the secondary closed end 430 of the float 400. The loops 470, 480 may be elongate strips that are configured to attach to one another, such as a mating pair of hook-and-loop fastener strips. Any of a variety of other types of fastening means may be used to secure the secondary gunwale float 400 to a side rail or other structure.

The secondary gunwale float 400 may be generally rectangular in overall shape and may include a secondary bottom layer 410 and a generally opposing secondary top layer 420. According to various embodiments, the float 400 may also include a secondary intermediate layer (similar to the one shown in FIG. 4). The layers 410, 420 and other parts of the float 400 may be made of a fabric that is suitable for use in marine environments, such as water-resistant canvas, nylon cloth, or any of a variety of synthetic fabrics. The secondary gunwale float 400, as shown, includes a secondary first edge 450 (across the top, in FIG. 5) and a generally opposing secondary second edge 460; a secondary closed end 430 and a generally opposing secondary open end 440.

As shown in FIG. 5, the secondary gunwale float 400 may define a secondary bladder pouch 520 that is sized and shaped to support a selectively inflatable secondary bladder 530. The secondary bladder 530 may include a secondary inflation valve 532 positioned in a filler tube that extends through a secondary opening 535 in the secondary top layer 420. The secondary valve 532 may be a three-part two-port check valve, like the kind used for inflatable boats, mattresses, pool toys and the like, to prevent unintended deflation. The secondary opening 535 may be a simple eyelet and may be reinforced by a grommet, as shown. The secondary bladder pouch 520 may be defined by secondary the secondary top surface 420 and the secondary intermediate layer, and may extend along only a portion of the length and width of the float near the secondary closed end 430, as shown in FIG. 3. The intermediate layer may extend from near the secondary closed end 430 to an intermediate location or to a location that is at or near the secondary open end 440. The secondary bladder 530 may be shaped to fit within the secondary bladder pouch 520 and sized in volume to hold enough air to lift at least a portion of the gunwale of a boat far enough above the water to impede the intrusion of water into the boat during righting. In this aspect, the size and shape of the secondary bladder 530, and the secondary gunwale float 400 supporting it, will vary depending on the size and shape of the boat. Larger or heavier boats will require larger bladders housed within larger floats. Moreover, longer boats such as canoes may benefit from the use of multiple bladders housed within multiple floats, spaced apart along the side, as described herein.

The secondary gunwale float 400 may further include a secondary long pouch 500. The secondary long pouch 500, as shown in FIG. 5, may be defined by the secondary bottom layer 410 and either the secondary top layer 420 or a portion of an intermediate layer. The secondary long pouch 500 may extend along nearly the entire length and width of the float 400 from the secondary open end 440 to the secondary closed end 430. The secondary long pouch 500 may be sized and shaped to releasably receive the blade or other part of a paddle 70 (as shown in FIG. 6 for the primary gunwale float 200). In use, as described herein, the blade of a paddle 70 may be inserted into the secondary long pouch 500. When the secondary bladder 530 is inflated, the secondary bladder pouch 520 may be forced against the paddle 70, thus helping to secure the float 400 to the paddle 70. In this aspect, the inflated secondary gunwale float 400 when placed around the blade of a paddle 70 creates a secondary outrigger (like the outrigger 600 shown in FIG. 6) that extends over and beyond the gunwale. The secondary outrigger facilitates the stability of a righted boat and helps to support a person climbing out of the water and into the boat. The secondary outrigger may be secured to the boat, for example, by using one or more straps to releasably attach it to one of the thwarts.

As described herein, the secondary long pouch 500 is optional and not a necessary element of the secondary gunwale float 400 in performing its function of lifting one of the gunwales during the righting of a capsized boat. In this aspect, one embodiment of the secondary gunwale float 400 includes only a secondary bladder pouch 520 defined by two layers of fabric. Referring to FIG. 5, this single-pouch embodiment would include only the secondary bottom layer 410 and the secondary top layer 420; with no secondary open end 440 between layers and no secondary long pouch 500.

Referring again to FIG. 5, the secondary top layer 420 may include a secondary top elongate fastener 475 positioned along the secondary first edge 450. The secondary bottom layer 410 may include a secondary bottom elongate fastener 485 along the secondary second edge 460, as shown. The secondary elongate fasteners 475, 485 may be elongate strips that are configured to attach to one another, such as a mating pair of hook-and-loop fastener strips. Other types of fasteners may be used that are suitable for marine environments. In this aspect, when the secondary gunwale float 400 is wrapped around a cylindrical surface, such as one of the cushions on a thwart, the mating faces of the secondary elongate fasteners 475, 485 will meet and connect. In one embodiment, the secondary gunwale float 400 may be sized and shaped in width to fit around an elongate, generally cylindrical bow cushion 62 on the bow thwart 32 (as shown in FIG. 1) so that the secondary gunwale float 400 can be stored around the bow cushion 62 and located easily when needed.

In use, the vessel righting system 100 facilitates the righting of a capsized watercraft 10 by a person or boater 80, typically in deep water. When capsized, one or both gunwales 41, 49 may lie below the surface 90 of the water. As illustrated in FIG. 1, the proximal gunwale 41 is the upper edge of the side of the canoe 10, nearest to the viewer. The distal gunwale 49 is on the far side of the canoe 10. The canoe 10 may be equipped with a proximal side rail 51 and a distal side rail 59. The canoe 10 in FIG. 1 has a bow thwart 32, a center or midship thwart 35, and a stern thwart 38. The bow thwart 32 is covered by a bow cushion 62. The center thwart 35 is covered by a center cushion 65. As described herein, the primary gunwale float 200 may be secured around the center cushion 65. The secondary gunwale float 400, when present, may be secured around the bow cushion 62.

When a watercraft is capsized, the boater 80 may begin, according to an exemplary method, by removing the primary gunwale float 200 from its storage location, which may be the center cushion 65. Referring to FIG. 3, the primary gunwale float 200 may be removed by releasing the top elongate fastener 275 from its attachment to the bottom elongate fastener 285.

The bladder 330 in the primary gunwale float 200 may then be manually inflated by the boater 80 using the valve 332. After inflation, the float 200 may then be attached to the boat near one of the gunwales (which will become the distal gunwale 49 when the boater 80 later moves to the other side of the boat) using at least one of the selectively openable loops 270, 280. The primary gunwale float 200 may be attached to the side rail 59 if one is present.

After the primary gunwale float 200 is attached, the boater 80 may then move around to the other side of the boat (which will be the near side or proximal gunwale 41) and begin lifting the boat 10 above the surface 90 of the water, as illustrated in FIG. 2. The boater 80 may lift by pushing on any portion of the boat 10, such as the center thwart 35 or cushion 65, as shown. During lifting, the boat 10 in general will rotate around the distal gunwale 49. The inflated bladder 330 inside the primary gunwale float 200 will keep at least a portion of the distal gunwale 49 at least partially above the surface 90 of the water and, thus, impede the unwanted entry of water into the boat. When the boat 10 is lifted to a position that is nearly vertical relative to the water surface 90, the boat 10 will continue rotating until it is righted and the hull rests in the water.

The system 100, as described herein, may include one or more secondary gunwale floats 400. The boater 80 may use a secondary gunwale float 400 by first removing it from its storage location, which may be the bow cushion 62. Referring to FIG. 5, the secondary gunwale float 400 may be removed by releasing the secondary top elongate fastener 475 from its attachment to the secondary bottom elongate fastener 485.

The secondary bladder 530 in the secondary gunwale float 400 may then be manually inflated by the boater 80 using the secondary valve 532. After inflation, the secondary gunwale float 400 may then be attached to the boat near one of the gunwales (which will become the distal gunwale 49 when the boater 80 later moves to the other side of the boat) using at least one of the secondary selectively openable loops 470, 480. The secondary gunwale float 400 may be attached to the side rail 59 if one is present. The secondary gunwale float 400 may be positioned so that it is spaced apart from the primary gunwale float 200 along the distal gunwale 49 or side rail 59.

After the secondary gunwale float 400 is attached, the boater 80 may then move around to the other side of the boat (which will be the near side or proximal gunwale 41) and begin lifting the boat 10 above the surface 90 of the water, as illustrated in FIG. 2. The boater 80 may lift by pushing on any portion of the boat 10, such as the center thwart 35 or cushion 65, as shown. During lifting, the boat 10 in general will rotate around the distal gunwale 49. The secondary gunwale float 400, in cooperation with the primary gunwale float 200, will keep at least a portion of the distal gunwale 49 at least partially above the surface 90 of the water and, thus, impede the unwanted entry of water into the boat. When the boat 10 is lifted to a position that is nearly vertical relative to the water surface 90, the boat 10 will continue rotating until it is righted and the hull rests in the water.

After righting the boat, the boater 80 is typically still in the water. In another aspect of the embodiments described herein, the boater 80 may use one or more gunwale floats as part of another or supplemental method of climbing out of the water and into the righted boat. In this method, the boater 80 may detach one or both of the floats 200, 400 from the distal gunwale 49 of the boat.

For example, the boater 80 may detach the primary gunwale float 200 from the distal side rail 59 and deflate the bladder 330. The blade or other portion of a paddle 70 may be inserted into the long pouch 300 to that the blade is positioned against or behind the bladder pouch 320. The bladder 330 may then be inflated manually using the valve 332 until the bladder pouch 320 presses against the blade or other portion of the paddle 70, thereby helping to secure the paddle 70 inside the long pouch 300. In this aspect, the inflated gunwale float 200 secured to the paddle 70 may act as an outrigger 600, as shown in FIG. 6. The boater 80 may then secure the paddle 70 to one of the thwarts using one or more straps 670, 680. Once secured, the outrigger 600 may be used as a support when the boater 80 climbs out of the water and into the righted boat.

Once inside the boat, the boater 80 may then detach the floats 200, 400, deflate the bladders 330, 530, and store the floats for later use. For example, the floats 200, 400 may be secured around one of the thwart cushions, using the elongate fasteners to secure the first edge to the second edge.

Although several embodiments have been described herein, those of ordinary skill in art, with the benefit of the teachings of this disclosure, will understand and comprehend many other embodiments and modifications for this technology. The invention therefore is not limited to the specific embodiments disclosed or discussed herein, and that may other embodiments and modifications are intended to be included within the scope of the appended claims. Moreover, although specific terms are occasionally used herein, as well as in the claims that follow, such terms are used in a generic and descriptive sense only and should not be construed as limiting the described invention or the claims that follow.

The invention claimed is:

1. A system for righting a capsized boat, comprising:

a primary gunwale float having at least one selectively openable loop that is sized and shaped to releasably secure said primary gunwale float near a distal gunwale of a boat, wherein said primary gunwale float defines a bladder pouch for supporting a selectively inflatable bladder, wherein said primary gunwale float lifts at least a portion of said distal gunwale at least partially above the surface of a body of water and thereby impedes the entry of water into said boat when at least a portion of a proximal gunwale of said boat is lifted at least partly above said surface by a boater; and a secondary gunwale float having at least one secondary selectively openable loop that is sized and shaped to releasably secure said secondary gunwale float near a distal gunwale of a boat, wherein said secondary gunwale float defines a secondary bladder pouch for supporting a selectively inflatable secondary bladder, wherein said secondary gunwale float lifts at least a portion of said distal gunwale at least partially above the surface of a body of water and thereby impedes the entry of water into said boat when at least a portion of a proximal gunwale of said boat is lifted at least partly above said surface by a boater, wherein said primary gunwale float and said secondary gunwale float are spaced apart along said distal gunwale.

2. The system of claim 1, wherein said secondary gunwale float has a secondary bottom layer and a secondary top layer, a secondary first edge and a generally opposing secondary second edge, said secondary gunwale float further comprising:

a secondary top elongate fastener oriented lengthwise along and near said secondary first edge and attached to said secondary top layer; and a secondary bottom elongate fastener oriented lengthwise along and near said secondary second edge and attached to said secondary bottom layer, wherein said secondary gunwale float is sized in width to facilitate the mating and releasable attaching of said secondary top and bottom elongate fasteners when said secondary gunwale float is wrapped around a generally cylindrical support on said boat, wherein said secondary gunwale float comprises a secondary top layer, a secondary bottom layer, and a secondary intermediate layer, and wherein said secondary top layer and said secondary intermediate layer define said secondary bladder pouch.

3. The system of claim 2, wherein said secondary gunwale float further includes a secondary open end and a secondary closed end, and wherein said secondary top layer and said secondary bottom layer define a secondary long pouch that extends from said secondary open end to near said secondary closed end and is sized and shaped to releasably receive a part of a paddle.

4. The system of claim 3, for further facilitating the entry of a person from the water into a righted boat, said system comprising:

a secondary outrigger comprising said part of a paddle inserted into said secondary long pouch of said secondary gunwale float, wherein said secondary selectively inflatable bladder is sized and shaped, when inflated, to releasably secure said secondary long pouch to said part of a paddle; and at least one secondary strap for releasably securing said secondary outrigger to at least one thwart on said righted boat, such that said secondary outrigger supports a person climbing out of the water and into a righted boat.

5. A method of righting a capsized boat comprising the steps of:

providing a primary gunwale float having at least one selectively openable loop, said primary gunwale float defining a bladder pouch for supporting a selectively inflatable bladder;

inflating said selectively inflatable bladder;

attaching said at least one selectively openable loop to a boat on or near a distal gunwale of said boat; and lifting a proximal gunwale of said boat above the surface of the water, while said primary gunwale float lifts at least a portion of said distal gunwale at least partially above said surface and thereby impedes the entry of water into said boat, until said boat is righted, wherein said boat includes a distal side rail mounted near said distal gunwale, and wherein said step of attaching comprises fastening said at least one selectively openable loop to said distal side rail.

6. The method of claim 5, further comprising the steps of:

providing a secondary gunwale float having at least one secondary selectively openable loop said secondary gunwale float defining a secondary bladder pouch for supporting a selectively inflatable secondary bladder;

inflating said selectively inflatable secondary bladder;

attaching said at least one secondary selectively openable loop to a boat on or near said distal gunwale of said boat, spaced apart from said primary gunwale float; and lifting a proximal gunwale of said boat above the surface of the water, while said primary gunwale float and said secondary gunwale float cooperate to lift at least a portion of said distal gunwale at least partially above said surface and thereby impedes the entry of water into said boat, until said boat is righted.

7. The method of claim 6, wherein said boat includes a distal side rail mounted near said distal gunwale, and wherein said step of attaching comprises fastening said at least one secondary selectively openable loop to said distal side rail.

* * * * *